US009828649B2

(12) United States Patent
Fortunati et al.

(10) Patent No.: US 9,828,649 B2
(45) Date of Patent: Nov. 28, 2017

(54) PROCESS FOR THE PRODUCTION OF GRAIN-ORIENTED MAGNETIC SHEET WITH A HIGH LEVEL OF COLD REDUCTION

(71) Applicant: Centro Sviluppo Materiali S.p.A., Rome (IT)

(72) Inventors: Stefano Fortunati, Rome (IT); Stefano Cicale', Rome (IT); Giuseppe Abbruzzese, Rome (IT)

(73) Assignee: CENTRO SVILUPPO MATERIALI S.P.A., Rome (RM) (IT)

( * ) Notice: Subject to any disclaimer, the term of this patent is extended or adjusted under 35 U.S.C. 154(b) by 906 days.

(21) Appl. No.: 14/349,238

(22) PCT Filed: Oct. 3, 2012

(86) PCT No.: PCT/IT2012/000305

§ 371 (c)(1),
(2) Date: Apr. 2, 2014

(87) PCT Pub. No.: WO2013/051042

PCT Pub. Date: Apr. 11, 2013

(65) Prior Publication Data

US 2014/0311629 A1 Oct. 23, 2014

(30) Foreign Application Priority Data

Oct. 5, 2011 (IT) ..... RM2011A0528

(51) Int. Cl.
*C21D 8/12* (2006.01)
*H01F 41/02* (2006.01)

(52) U.S. Cl.
CPC ..... *C21D 8/12* (2013.01); *C21D 8/1211* (2013.01); *C21D 8/1222* (2013.01); *C21D 8/1233* (2013.01); *C21D 8/1261* (2013.01); *C21D 8/1266* (2013.01); *H01F 41/02* (2013.01)

(58) Field of Classification Search
CPC ..... C21D 8/12; C21D 8/1211; C21D 8/1222; C21D 8/1233; C21D 8/1261
See application file for complete search history.

(56) References Cited

U.S. PATENT DOCUMENTS

2012/0222777 A1* 9/2012 Fortunati ..... B22D 11/001 148/208

FOREIGN PATENT DOCUMENTS

| | | | |
|---|---|---|---|
| DE | 10060950 | A1 | 6/2002 |
| EP | 0709470 | A1 | 5/1996 |
| WO | 02/50318 | A1 | 6/2002 |

* cited by examiner

*Primary Examiner* — Alexander Polyansky
(74) *Attorney, Agent, or Firm* — Lucas & Mercanti, LLP

(57) ABSTRACT

Process for the production of grain-oriented Fe—Si sheets having excellent magnetic characteristics to be used for construction of electrical devices wherein the thickness of hot rolled strip (_>3.5 mm) and the total cold deformation rate (90-98%) are higher than known processes, and wherein hot rolled strip annealing before cold rolling is not scheduled.

8 Claims, No Drawings

PROCESS FOR THE PRODUCTION OF GRAIN-ORIENTED MAGNETIC SHEET WITH A HIGH LEVEL OF COLD REDUCTION

CROSS-REFERENCE TO RELATED APPLICATIONS

This application is a 371 of PCT/IT2012/000305, filed Oct. 3, 2012, which claims the benefit of Italian Patent Application No. RM2011A000528, filed Oct. 5, 2011, the contents of each of which are incorporated herein by reference.

FIELD OF THE INVENTION

The present invention refers to a process for the production of grain-oriented Fe—Si sheets having excellent magnetic characteristics to be used for construction of electrical devices.

BACKGROUND OF THE INVENTION

As it is known, magnetic grain-oriented sheets are used mainly for manufacturing of electric transformer cores.

Commercially available products are classified based on magnetic properties thereof (as defined according to UNI EN10107 rule).

Such magnetic characteristics are associated with special product crystalline structure displaying an anisotropic crystallographic texture ({110} <001>) and macroscopic grain size (from mm to cm).

In order such structures to be obtained it is necessary particularly long, complex and very expensive industrial manufacturing cycles to be carried out, high degree of process control being further required. For all the degrees but particularly for thinner thicknesses (i.e. <0.30 mm) and higher B800 products, both physical and magnetic process yields are particularly critical parameters resulting in a meaningfully incidence on product cost.

All current technologies for manufacturing of grain-oriented magnetic sheet take advantage of the same metallurgical strategy in order to obtain the extremely strong Goss texture for final sheets, that is the process for secondary oriented re-crystallization assisted by second and/or segregating phase distribution. Second not metallic phases and segregating agents play a critical role for control (slowing down) of grain boundary movement during final annealing step by addressing orientation selective secondary re-crystallization process.

For example according to EP 0125653, EP 098324, EP 0411356 inhibiting elements are mainly manganese sulfide and aluminum nitride (MnS+AlN).

The above described technology, however, results in a drawback deriving from inheritance of slab microstructure, displaying large grains generated during solidification process.

These grains, because of reduced mobility of grain boundary resulting from alloy silicon occurrence, preventing complete re-crystallization during the process, lead to microstructure heterogeneities in turn resulting in that within final product zones wherein the grain is fine and not subjected to a correct secondary crystallization (said streaks) occur thus leading to impaired magnetic characteristics.

Recently new steel casting technologies aiming to have still more compact, flexible and further reduced cost production processes have been developed. An innovative technology advantageously used for the production of transformer sheets is thin slab casting characterized by continuous casting of long pieces directly to typical thicknesses of conventional blank bars and well suited to embodiment of direct rolling processes by coupling in continuous sequence slab casting, passage in continuous tunnel furnaces for heating of casted pieces and finishing rolling to wound strips. Casting at reduced thickness limits the whole amount of applied mechanical deformation for hot rolling, which in turn results in higher incidence of above described drawback. The persistence of not re-crystallized zones is one of main problems referred to manufacturing technologies starting from thin slabs.

All the technologies for industrial production of grain-oriented magnetic sheet based on slab or ingot casting, share that thickness reduction starting from casted slab or ingot to thin strip (final product) is carried out by a first hot rolling and then a second cold rolling with hot reduction rates ranging from 90% to 99% and typically lower total cold reduction rates (85-90%).

Many technologies in order to improve the amount and homogeneity of strip hot re-crystallization for manufacturing of said steels on the base, for example, of particular hot rolling conditions, have been proposed. Among most recent thereof, for example in WO2010/057913 a process wherein slabs are hot rolled by adjusting temperature and blanking reduction grade according to bar temperature over time range from blanking and finish rolling, is described. In US2008/0216985A1 a special cycle for strip hot manufacturing by applying high deformation rate at first stand of finishing train is described. In EP 2147127 hot rolling process wherein it is not necessary casted slab to be heated before rolling and first hot rolling step is carried out at temperature lower than slab core, is described.

According to the present invention when cold deformation is applied without strip hot annealing, a particular micro structural strip homogeneity is obtained thus avoiding drawback resulting from grain size heterogeneity within annealed cold rolled steel and presence of streaks within final product.

As it is well known by those skilled in the art, moreover, the elimination of strip hot annealing step in production cycle represents firstly an opportunity in order to reduce the manufacturing costs (i.e. energy costs, productivity and physical yield increases) to put into effect whenever possible, although a preliminary cold rolling treatment for surface conditioning purpose by a continuous surface sandblasting process and/or acid pickling is considered necessary in order scale/oxidation material resulting from hot rolling to be removed from strip surface, is considered necessary. In methods involving strip hot annealing typically both the processes (annealing and pickling continuous lines) are carried out on same lines.

SUMMARY OF THE INVENTION

An object of the present invention is an innovative process for the manufacturing of grain-oriented magnetic sheet and intends to resolve the problem of negative effects on product quality characteristics and magnetic and physical yields of current manufacturing processes, as result of incomplete and heterogeneous re-crystallization of hot rolled strips as usual for said products.

DETAILED DESCRIPTION OF THE INVENTION

The present invention suggests, differently than described in the state of art, a manufacturing cycle based on a thickness of hot rolled strip >3.5 mm and very high total cold reduction from hot strip to final product thickness (>90%) without application of hot annealing on rolled steel. Said cycle results in very high amount of deformation reticular defects up to a critical limiting density whereby in successive strip annealing a very homogenous process of re-crystallization of rolled steel structure is activated. The inventors of the process object of the present invention have been able to demonstrate that in order said result to be obtained in effective and reliable way, it is not enough to subdivide the cold deformation amount in many steps spaced by intermediate annealing, but it is necessary to increase the hot strip thickness over than 3.5 mm and apply a total cold reduction higher than 90% without hot strip annealing.

The process is particularly effective for technologies wherein the total reduction starting from solidification size is limited (as for example for thin slab) and in any case it allows the production of magnetic sheets with excellent characteristics and qualitative yields higher than conventional methods.

It is usual for manufacturing of grain-oriented sheet to produce heated strips with thickness from 2.0 mm to 2.5 mm; in fact it is commonly thought that in industrial manufacturing processes of thin thickness rolled steels it is favorable to limit the amount of cold reduction to be applied due to obvious process cost reasons (the trend is toward the production of hot thinner thickness strips) also for manufacturing of electrical steels EP1662010A1). In JP60059045 and JP6207220 it is clearly described the application of a specific rate of cold reduction, for the manufacturing of ultrathin sheet (thickness ≤0.25 mm) with excellent magnetic characteristics, thus resulting in about 3 mm maximum thick hot strip.

Contrarily to general trend the present invention involves the preparation of a hot strip with thickness remarkably higher than typically found for these materials. The inventors in fact have been able to verify by an experiment set that doing so better and more reliable magnetic characteristics for final product are obtained. Such result probably is the consequence of a more homogenous microstructure of final thickness annealed semi-products. The inventors suggest, as an ulterior object of the present invention, a specific variant of the process, allowing a further production cost reduction, based on a treatment of hot treatment of high thickness strips involving strip unwinding, cold deformation by means of one or more online rolling stands, annealing of deformed strip, possible further strip online cold rolling by means of one or more stands and then strip rewinding to be sent to successive processing steps. Above said grouping of cold rolling and annealing allows remarkable reduction in manufacturing cost such that the proposed method is more economic than currently used ones and at the same time assures highest product quality.

According to the present invention it has been possible to identify specific process conditions, unknown according to the state of the art, allowing products with excellent magnetic characteristics assuring high reliability degree of final results and excellent stability of product functional characteristics and the high production yields to be obtained.

Object of the present invention is a process for the production of grain-oriented magnetic steel, wherein silicon steel is casted, solidified and sequentially subjected to possible heating, hot rolling, cold rolling, annealing, wherein:

the chemical composition of steel by weight percent is as below:

Si from 2.0% to 5.0%, C up to 0.1%, S from 0.004% to 0.040%, Cu up to 0.4%, Mn up to 0.5%, Cu+Mn being up to 0.5%, possible N from 0.0030% to 0.0120%, possible Al from 0.0100% to 0.0600%, balance Fe and unavoidable impurities;

the steel is solidified as 20 mm or higher thick slab or ingot and hot rolled at a temperature from 1350 to 800° C., obtaining hot rolled 3.5-12.0 mm thick strip;

hot rolled strip, without annealing, is cold rolled with total reduction rate from 90% to 98%, cold rolling being carried out according to the following schedule:

(1) first cold rolling at reduction rate from 20% to 60% and at temperature from 30° C. to 300° C., (2) annealing at temperature from 800° C. to 1150° C. over from 30 s to 900 s, (3) second cold rolling up to final thickness at reduction rate from 70% to 93% in or more steps with possible annealing at a temperature from 800° C. to 1150° C. and over from 30 s to 900 s.

In an embodiment of the process according to the present invention hot rolled strip is subjected online and continuously to following treatments: unidirectional cold rolling by means of one or more rolling stands in sequence by interposing among rolling cylinders like lubricant an oil-in-water emulsion at 1-8% concentration; annealing; cooling; and possibly successive cold rolling by means of use of one or more cold rolling stands.

Said strip after first cold rolling is annealed and then cooled, from 900-800° C. at 25° C./s cooling rate in 900-300° C. temperature range.

Said strip after cold rolling to 0.15-0.50 mm final thickness, is continuously annealed for primary re-crystallization occurring within one or more annealing boxes under controlled atmosphere and such to reduce strip carbon average content at values lower than 0.004%, to increase strip oxygen average content at average values from 0.020 to 0.100% and optionally to increase strip nitrogen average content up to 0.050% maximum.

Total hot reduction rate (at T>800° C.) applied to solidified product in form of slabs or ingots during hot rolling is lower than total cold reduction rate (T<300° C.) applied to strip with successive cold rolling steps up to final thickness.

Chemical composition of steel according to the present invention can further contain at least one of Niobium+Vanadium+Zirconium+Tantalum+Titanium+Tungsten up 0.1%, at least one of Chromium+Nickel+Molybdenum up to 0.4%, at least one of Tin+Antimony up to 0.2% and at least one of Bismuth+Cadmium+Zinc up to 0.01%.

The first cold rolling is carried out using working cylinders with diameter from 150 mm to 350 mm, at strip temperature from 30 to 300° C. and applying a specific rolling pressure lower than 500 N/mm$^2$. Second cold rolling is carried out in or more steps at temperature equal or lower than 180° C., with two or more sequentially arranged rolling stands.

The proposed process is applicable and advantageous for all known technologies for production of hot strips by ingot or slab casting. In particular the method displays to be advantageous for casting of thin slabs (up to 100 mm thick). In these cases in fact it is known that because of limited degree of hot deformation applied to solidified slabs up to final product, compared to casting with more conventional thickness (higher than 100 mm), hot produced strips are characterized in having more elevated re-crystallization heterogeneity not eliminated by normally applied cold deformation degrees.

As to alloy elements identified as necessary for the present invention in order products with final desired characteristics to be obtained the following considerations are to be pointed out.

Silicon content lower than 2.0% is not convenient because of alloy low electrical resistivity and tendency to austenite phase formation during final annealing also in the presence of low carbon content, while Silicon content higher than 5% results in too high mechanical embrittlement of final products, not compatible with user requirements.

Alloy carbon content higher than 0.1% is not convenient as final products must contain very low carbon content (typically <30 ppm) and times necessary for final thickness sheet decarburizing become too much long.

Copper and Manganese are used for formation of sulfides in metallic matrix for the control of the movement of crystal grain boundaries during scheduled hot treatments in claimed cycle. Content of Manganese higher than 0.50% Copper equal to 0.4% or Manganese+Copper higher than 0.5% is not convenient because results in instability of final magnetic characteristics, probably due to segregating phenomena and precipitate distribution formation in critically heterogeneous matrix.

Sulfur is used for the formation of Copper and Manganese sulfides. Content thereof lower than 0.004% is not sufficient for the precipitation of second phase volumetric fraction necessary for microstructure control resulting in magnetic instability of final products. Content higher than 0.040% is useless to this end and can lead to segregations deleterious for mechanical machinability and precipitate distribution formation in critically heterogeneous matrix.

Aluminum is present up to 0.060% in order during the manufacturing cycle nitride distribution to be adjusted. Content higher than said value displays to be deleterious for final magnetic characteristics, probably because of segregating phenomena. Alloy Nitrogen content is claimed to be in range from 0.003% to 0.0120%. Values lower than 0.003% are not convenient to this end and difficult to be industrially obtained. Content higher than prescribed is difficult to be obtained using typical manufacturing techniques for industrial steel and can produce surface defects on strips.

The increased tendency to re-crystallization and increased structure homogeneity of final thickness grain induced by claimed process conditions allow excellent magnetic characteristics to be obtained also without carrying out second cold rolling at temperatures higher than 180° C. (so called interpass-aging o warm rolling). Moreover, as result of first cold rolling and successive annealing, the mechanical properties of strips being subjected to second cold rolling (ductility) allow the latter to be performed sequentially with not reversible type rolling-mills (high productivity tandem rolling mill trains) with consequent advantage for production costs.

According to the prior art there are no industrial productions of magnetic sheets starting directly from casting in strip form and from scientific and patent literature it is known that one of main metallurgical and process problems for said technology type is represented by high hot embrittlement of produced strips resulting in serious problems for physical yields during successive final product passages in industrial transformation, wherein among most critical ones there is cold rolling step. For this reason solutions based on application of a remarkable grade of hot deformation online with strip casting thus limiting thickness of rolled strip before cold rolling have been proposed according to scientific and patent literature. If and when aforesaid problems associated with the manufacturing of directly solidified and hot rolled strips at thickness not lower than 3.5 mm will be resolved, then, according to the opinion of the authors of the present invention, the proposed method can also be advantageously applied in strip casting technologies.

The present invention up to now has been described in general terms and below by the following illustrative but non limitative examples the same will be described according to preferred embodiments thereof in order scopes, characteristics, advantages and application features to be better understood.

Example 1

Three alloys with different compositions, as reported in Table 1, have been prepared. 40 mm thick experimental slabs have been obtained from said alloys.

All these slabs have been hot rolled according to the following procedure: heating up to 1360° C. and holding at this temperature for 15 minutes, then hot rolling to 6.0 mm thickness.

Said hot rolled slabs then have been subjected to cold rolling to 2.2 mm thickness using like lubricant a water-in-oil emulsion, continuously annealed at 1000° C. for 30 seconds, air cooled to 900° C. and then water cooled to 300° C. in 15 seconds and finally again air cooled to ambient temperature. So produced rolled slabs then have been cold rolled to 0.30 mm thickness, with 95% total cold reduction rate, successively annealed under decarburizing atmosphere at 850° C. for 300 seconds resulting in carbon content reduction below 0.003% and average oxygen content increase of about 0.08%. On rolled slabs then MgO based annealing separator has been applied and static annealing has been carried out up to 1210° C.

TABLE 1

| ALLOY % | Si | C | Mn | Cu | Mn + Cu | S | Al | N |
|---|---|---|---|---|---|---|---|---|
| A | 2.05 | 0.01 | 0.07 | 0.09 | 0.16 | 0.038 | | |
| B | 3.90 | 0.05 | 0.10 | 0.30 | 0.40 | 0.016 | | |
| C | 3.20 | 0.05 | 0.20 | 0.10 | 0.30 | 0.004 | 0.028 | 0.008 |

In Table 2 magnetic characteristics measured for samples from three different experimental alloys according to inventive procedure are reported. (B800 is induction in Tesla units under 800 A/m applied field, P17 is magnetic loss measured by Watt for Kg under 1.7 Tesla work induction, GS is average value of crystalline grain size (surface) of final product.)

TABLE 2

| Alloy | B800 Tesla | P17 W/Kg(50 Hz) | GS $Mm^2$ |
|---|---|---|---|
| A | 1.98 | 1.15 | 19 |
| B | 1.89 | 0.94 | 14 |
| C | 1.94 | 0.95 | 210 |

Example 2

Alloy containing Silicon 3.2%, Carbon 0.05%, Manganese 0.23%, Copper 0.15%, Aluminum 0.032%, Sulfur 0.01%, Nitrogen 0.0081%, Titanium 0.003%, Niobium 0.002%, Zirconium 0.001%, Tin 0.092%, Chromium 0.032%, Nickel 0.012%, Molybdenum 0.010% has been solidified in form of 50 mm thick slabs and a set of produced samples is heated at 11.20° C. for approximately 20 minutes and hot rolled at different thickness; successively said samples have been cold rolled with reversible rolling-mill using like lubricant 2% water-in-oil emulsion, according to Table 3 schedule, wherein average intermediate thickness values used in individual tests are reported. All thus produced rolled slabs then have been subjected to intermediate annealing at 1100° C. for 90 sec under dry nitrogen atmosphere followed by air cooling to 860° C. and then water annealed from 860° C. to 300° C. over from 12 to 18 seconds. Annealed rolled slabs then have been cold rolled a second time to final thickness (Total cold RR refers total cold reduction rate); thicknesses and reduction rates as used in various tests are reported in Table 3. Various rolled slabs at final thicknesses then have been subjected to decarburizing and nitriding treatment so as to reduce Carbon content below 0.003% and introduce nitrogen amount in sheet from 0.0150% to 0.024%. At the end of treatment for all the sheets Oxygen content was from 0.075% to 0.0950%. At the end of treatment on all the sheets a MgO based annealing separator has been applied and static annealing carried out up to 1210° C. Obtained results are reported in Table 3. As it is clear from said data by applying the instructions according to the invention it is possible to obtain products with excellent magnetic characteristics.

TABLE 3

| TEST | Slab thikness mm | Hot Rolled thickness mm | 1st CR thickness mm | 1st cold RR % | Annealing ° C. | final thickness mm | Total cold RR % | B800 Tesla | P17 W/Kg | Cycle |
|---|---|---|---|---|---|---|---|---|---|---|
| 1 | 50 | 1.80 | 1.00 | 44% | 1100 | 0.23 | 87% | 1.60 | 2.15 | |
| 2 | 50 | 2.20 | 1.00 | 55% | 1100 | 0.27 | 88% | 1.59 | 2.12 | |
| 3 | 50 | 2.20 | 1.00 | 55% | 1100 | 0.30 | 86% | 1.63 | 1.92 | |
| 4 | 50 | 2.20 | 1.80 | 18% | 1100 | 0.27 | 88% | 1.61 | 2.22 | |
| 5 | 50 | 2.80 | 1.50 | 46% | 1100 | 0.30 | 89% | 1.76 | 1.56 | |
| 6 | 50 | 3.60 | 2.40 | 33% | 1100 | 0.30 | 92% | 1.94 | 0.95 | inv. |
| 7 | 50 | 3.50 | 2.70 | 23% | 1100 | 0.30 | 91% | 1.91 | 1.02 | inv. |
| 8 | 50 | 5.00 | 2.70 | 46% | 1100 | 0.35 | 93% | 1.94 | 0.98 | inv. |
| 9 | 50 | 8.00 | 2.80 | 65% | 1100 | 0.35 | 96% | 1.94 | 0.97 | inv. |
| 10 | 50 | 12.00 | 3.00 | 75% | 1100 | 0.50 | 96% | 1.95 | 1.37 | inv. |

Example 3

Several 50 mm thick slabs of alloy used in test described in previous example have been annealed at 1200° C. for 20 minutes and then hot rolled to 5 mm thickness. So produced rolled slabs successively have been cold rolled to mm 2.5 thickness and subjected to different hot treatments at soaking temperature T1, with possible second following soaking temperature T2 (double soaking), with starting accelerated cooling temperature T3 and processing time tq in temperature range from T3 to 300° C. according to schedule showed in table 4. Annealed rolled slabs then have been cold rolled to 0.30 mm thickness and afterwards subjected to decarburizing and nitriding annealing step. For all the tests Carbon content has been reduced below 0.003% and nitrogen amount in all sample sheets from 0.020% to 0.025% has been introduced. At the end of the treatment for all the sheets measured Oxygen content was approximately 0.08%. At the end of treatment on all the sheets a MgO based annealing separator has been applied and static annealing carried out at 1180° C. Obtained results are reported in Table 4 (in the table, CR means cold rolling, RR means reduction rate, Cycle mean cycle, tq means cooling time).

Example 4

Alloy containing Silicon 3.1%, Carbon 0.073%, Manganese 0.076%, Copper 0.090%, Sulfur 0.028%, Titanium 0.002%, Niobium 0.001%, Tungsten 0.002%, Tin 0.100%, Chromium 0.012%, Nickel 0.010%, Molybdenum 0.009% has been solidified in form of 200 mm thick slabs and a set of produced samples is heated at 1400° C. for approximately 30 minutes and rolled to 6 mm thickness. So prepared hot rolled slabs have been subjected to a set of cold rolling and annealing steps in continuous sequence using an experimental apparatus. Continuously performed treatment sequence is described in table 5. Particularly sequence process is characterized by two cold rolling passes with 7% lubricating water-in-oil emulsion in order to reduce the thickness of rolled sheets from 4 mm to 1.8 mm, then subsequently annealing step at 980° C. for 30 second (T1), air cooling to 850° C. (T3) and water annealing from 850° C. to 300° C. in 16 second (tq), afterwards, in quick sequence, a second cold rolling step from 1.8 mm to 0.35 mm thickness of mm in 4 passes.

TABLE 4

| TEST | Slab thikness mm | Hot Rolled thickness mm | 1st CR thickness mm | 1st cold RR % | Annealing & Cooling T1 ° C. | T2 ° C. | T3 ° C. | tq sec | final thickness mm | Total cold RR % | B800 Tesla | P17 W/Kg | Cycle |
|---|---|---|---|---|---|---|---|---|---|---|---|---|---|
| 1 | 50 | 5.00 | 2.50 | 50% | 1200 | 850 | 840 | 18 | 0.30 | 94% | 1.77 | 1.54 | |
| 2 | 50 | 5.00 | 2.50 | 50% | 1150 | 850 | 840 | 17 | 0.30 | 94% | 1.93 | 0.97 | inv. |
| 3 | 50 | 5.00 | 2.50 | 50% | 1000 | 850 | 840 | 17 | 0.30 | 94% | 1.94 | 0.92 | inv. |
| 4 | 50 | 5.00 | 2.50 | 50% | 900 | 850 | 840 | 18 | 0.30 | 94% | 1.94 | 0.93 | inv. |
| 5 | 50 | 5.00 | 2.50 | 50% | 750 | 850 | 840 | 18 | 0.30 | 94% | 1.64 | 2.01 | |
| 6 | 50 | 5.00 | 2.50 | 50% | 1050 | 950 | 940 | 20 | 0.30 | 94% | 1.79 | 1.42 | |
| 7 | 50 | 5.00 | 2.50 | 50% | 1050 | 950 | 900 | 19 | 0.30 | 94% | 1.93 | 0.95 | inv. |
| 8 | 50 | 5.00 | 2.50 | 50% | 1050 | 950 | 850 | 18 | 0.30 | 94% | 1.94 | 0.95 | inv. |
| 9 | 50 | 5.00 | 2.50 | 50% | 1050 | 950 | 800 | 17 | 0.30 | 94% | 1.92 | 0.98 | inv. |
| 10 | 50 | 5.00 | 2.50 | 50% | 1050 | 950 | 700 | 15 | 0.30 | 94% | 1.78 | 1.45 | |
| 11 | 50 | 5.00 | 2.50 | 50% | 1050 | 950 | 860 | 10 | 0.30 | 94% | 1.93 | 0.93 | inv. |
| 12 | 50 | 5.00 | 2.50 | 50% | 1050 | 950 | 870 | 18 | 0.30 | 94% | 1.94 | 0.95 | inv. |
| 13 | 50 | 5.00 | 2.50 | 50% | 1050 | 950 | 860 | 50 | 0.30 | 94% | 1.80 | 1.39 | |
| 14 | 50 | 5.00 | 2.50 | 50% | 1050 | 950 | 860 | 80 | 0.30 | 94% | 1.79 | 1.40 | |

TABLE 5

| 1st cold rolling | | | | annealing & cooling | | | | 2nd cold rolling | | | | | |
|---|---|---|---|---|---|---|---|---|---|---|---|---|---|
| thick IN mm | pass 1 % | pass 2 % | thick OUT mm | T1 ° C. | time at T1 sec | T3 ° C. | tq sec | thick IN mm | pass 1 % | pass 2 % | pass 3 % | pass 4 % | thick OUT mm |
| 4 | 35% | 31% | 1.8 | 980 | 30 | 850 | 16 | 1.8 | 40 | 35 | 30 | 28 | 0.35 |

Described sequence is repeated starting from 8 hot rolled sheets of the same heat.

All so produced cold rolled sheets then have been annealed under decarburizing atmosphere at 850° C. for 300 second with reduction of carbon content below 0.003% and increase of oxygen average content of approximately 0.08%. Subsequently on all the sheets a MgO based annealing separator has been applied and subjected to static annealing carried out up at 1210° C. At the end of the process final sheets have been magnetically characterized according to usual standard rule and obtained results are reported in table 6. Produced sheets displayed to have excellent, stable and reliable magnetic quality.

TABLE 6

| Sample | B800 Tesla | P17 W/Kg |
|---|---|---|
| 1 | 1.94 | 0.98 |
| 2 | 1.94 | 0.97 |
| 3 | 1.93 | 0.99 |
| 4 | 1.94 | 0.97 |
| 5 | 1.94 | 0.97 |
| 6 | 1.94 | 0.98 |
| 7 | 1.93 | 0.98 |
| 8 | 1.94 | 0.97 |

Example 5

Alloy containing Silicon 2.1%, Carbon 0.04%, Manganese 0.10%, Copper 0.10%, Aluminum 0.022%, Sulfur 0.02%, Nitrogen 0.010%, Titanium 0.003%, Niobium 0.001%, Tin 0.015%, Bismuth 0.005 has been solidified in form of 225 mm thick slabs and a set of produced items is heated at 1420° C. for approximately 20 minutes and hot rolled to 4 mm thickness in temperature range from 1310° C. to 920° C.; a group (5 samples) of produced hot bands has been annealed for 120 second at 1100° C. under Nitrogen atmosphere and then cold rolled to 2.3 mm thickness while another group (other 5 samples) has been cold rolled without the strip hot annealing. All so produced sheets afterwards have been subjected to an intermediate annealing at 1130° C. for 90 sec under dry nitrogen atmosphere followed by air cooling to 870° C. and subsequently water annealed from 870° C. to 300° C. in 12 to 18 seconds. Then annealed rolled sheets have been cold rolled a second time to 0.27 mm thickness. All the rolled sheets at final thickness then have been quickly subjected to decarburizing treatment at 850° C. for 150 seconds under humidified 75% H2-25% N2 atmosphere with pdr equal to 69° C. At the end of treatment on all the sheets a MgO based annealing separator has been applied and static annealing carried out up to 1210° C.

Obtained results are brought back in Table 7.

TABLE 7

| TEST | Hot Rolled thickness mm | HOT BAND Annealing ° C. | 1st CR thickness mm | Annealing ° C. | final thickness mm | Total cold RR % | B800 Tesla | P17 W/Kg | Cycle |
|---|---|---|---|---|---|---|---|---|---|
| 1 | 5.00 | Yes | 2.30 | 1100 | 0.27 | 94.6% | 1.63 | 2.52 | |
| 2 | 5.00 | Yes | 2.30 | 1100 | 0.27 | 94.6% | 1.59 | 2.72 | |
| 3 | 5.00 | Yes | 2.30 | 1100 | 0.27 | 94.6% | 1.68 | 2.48 | |
| 4 | 5.00 | Yes | 2.30 | 1100 | 0.27 | 94.6% | 1.60 | 2.53 | |
| 5 | 5.00 | Yes | 2.30 | 1100 | 0.27 | 94.6% | 1.58 | 2.91 | |
| 6 | 5.00 | No | 2.30 | 1100 | 0.27 | 94.6% | 1.97 | 0.95 | inv. |
| 7 | 5.00 | No | 2.30 | 1100 | 0.27 | 94.6% | 1.97 | 0.96 | inv. |
| 8 | 5.00 | No | 2.30 | 1100 | 0.27 | 94.6% | 1.98 | 0.95 | inv. |
| 9 | 5.00 | No | 2.30 | 1100 | 0.27 | 94.6% | 1.97 | 0.95 | inv. |
| 10 | 5.00 | No | 2.30 | 1100 | 0.27 | 94.6% | 1.97 | 0.96 | inv. |

The invention claimed is:

1. A process for the production of grain oriented magnetic strip, wherein a silicon steel is cast, solidified and subjected to, hot rolling, cold rolling and optional heating, annealing, wherein:

the steel has a composition expressed in percent by weight comprising:

Si 2.0%-5.0%, C up to 0.1%, S 0.004%-0.040%, Cu up to 0.4%, Mn up to 0.5%, the Cu and Mn being up to 0.5%, optionally N 0.0030%-0.0120%, optionally Al 0.0100%-0.0600%, and optionally, up to 0.1% of at least one of Niobium, Vanadium, Zirconium, Tantalum, Titanium, and Tungsten, up to 0.4% of at least one of Chromium, Nickel, and Molybdenum, up to 0.2% of at least one of Tin and Antimony and up to 0.1% of at least one of Bismuth, Cadmium, and Zinc, the remaining being Fe and unavoidable impurities;

the process comprising the steps of solidifying the steel as slab or ingot having a thickness equal to or greater than 20 mm and hot rolling at the temperature range of 800 1350° C., to obtain a hot rolled sheet having a thickness between 3.5 mm and 12.0 mm, the hot rolled sheet so obtained is thereafter being cold rolled without annealing, wherein the total reduction ratio is not lower than 90% and not higher than 98%, the cold rolling being applied by the following sequence:

(1) a first cold rolling with a reduction ratio of between 20% and 60% at a temperature between 30° C. and 300° C.;

(2) annealing to temperature of between 800° C. and 1150° C. for between 30 seconds and 900 seconds; and (3) a second cold rolling to final thickness with a reduction ratio of between 70% and 93% in one or several stages with optional annealing to a temperature of between 800° C. and 1150° C. and for a time of between 30 seconds and 900 seconds.

2. The process according to claim 1, wherein the hot rolled sheet is in line and continuously subjected to: one way cold rolling by one or more rolling stands in sequence, interposing between the rolling cylinders of the roller stands an emulsion of oil in water with a concentration in the range of 1-8% as a lubricant, annealing, cooling, and optionally subsequent cold rolling using one or more cold rolling stands.

3. The process according to claim 1, wherein the strip after the first cold rolling is annealed and then cooled from a starting temperature of between 800 and 900° C. at a cooling rate above 25° C./s at a temperature range of 300-900° C.

4. The process according to claim 1, wherein the strip, after cold rolling to final thickness of between 0.15 and 0.50 mm, is continuously annealed to develop primary recrystallization annealing in one or more controlled atmosphere annealing rooms in order to reduce the average carbon content of the strip to less than 0.004%, to increase the average oxygen content of the strip to average values of between 0.020 and 0.100%, and optionally to increase the average nitrogen content of the strip up to a maximum of 0.050%.

5. The process according to claim 1, wherein the overall rate of reduction of hot rolling (T>800° C.) applied to the solidified slabs or ingots during the hot rolling is lower than the overall rate of cold rolling (T<300° C.) applied to the strip with subsequent cold rolling up to final thickness.

6. The process according to claim 1, wherein the first cold rolling is carried out using working rolls having a diameter of between 150 mm and 350 mm, with a temperature of the strip of between 30 and 300° C. and applying a tension strip less than 500 $N/mm^2$.

7. The process according to claim 1, wherein the second cold rolling is carried out in one or more stages with a temperature equal or less than 180° C.

8. The process according to claim 7, wherein the second cold rolling is carried out by two or more not reversible rolling stands in sequence.

* * * * *